US012292271B2

(12) United States Patent
Loganathan

(10) Patent No.: US 12,292,271 B2
(45) Date of Patent: May 6, 2025

(54) WEDGING ARRANGEMENT TO PLUG A BLAST HOLE

(71) Applicant: Vinesh Loganathan, Phoenix (ZA)

(72) Inventor: Vinesh Loganathan, Phoenix (ZA)

( * ) Notice: Subject to any disclaimer, the term of this patent is extended or adjusted under 35 U.S.C. 154(b) by 0 days.

(21) Appl. No.: 18/288,993

(22) PCT Filed: Sep. 28, 2021

(86) PCT No.: PCT/IB2021/058843
§ 371 (c)(1),
(2) Date: Oct. 30, 2023

(87) PCT Pub. No.: WO2022/238749
PCT Pub. Date: Nov. 17, 2022

(65) Prior Publication Data

US 2024/0230303 A1 Jul. 11, 2024

(30) Foreign Application Priority Data

May 10, 2021 (ZA) ..... 202103117

(51) Int. Cl.
*F42D 1/18* (2006.01)

(52) U.S. Cl.
CPC ..... *F42D 1/18* (2013.01)

(58) Field of Classification Search
CPC ..... E21B 33/12
See application file for complete search history.

(56) References Cited

U.S. PATENT DOCUMENTS 102,250 A * 4/1870 Gomez ..... F42D 1/18 102/304
650,803 A * 5/1900 Vesey ..... F42D 1/18 102/304

(Continued)

FOREIGN PATENT DOCUMENTS

WO 02090873 A1 11/2002
WO 2015035456 A1 9/2014

OTHER PUBLICATIONS

International Search Report (ISR) and Written Opinion (WO) issued on Dec. 20, 2021 in connection with International Appln. No. PCT/IB21/058843.

*Primary Examiner* — Joshua E Freeman
(74) *Attorney, Agent, or Firm* — DiPerna Law Firm, P.C.; Raymond A. DiPerna

(57) ABSTRACT

The invention relates to a wedging arrangement to plug a blast hole accommodating an explosive charge. The wedging arrangement comprises a body comprising a first part and a second part arranged to angularly slide relative to each other. Each of the first and second parts defines a holding arrangement for holding the first and second parts relative to each other. The wedging arrangement is configurable between a default configuration in which the holding arrangement holds the first and second parts relative to each other, and a stressed configuration in which the body is subjected to external stress forces thereby causing the holding arrangement to be disengaged to allow the first and second parts to angularly slide relative to each other, in use to locate and lock the wedging arrangement in place within the blast hole in order to plug the blast hole and contain the blast energy resulting from the explosive charge being detonated.

18 Claims, 12 Drawing Sheets

(56) References Cited

U.S. PATENT DOCUMENTS

| | | | | | |
|---|---|---|---|---|---|
| 650,804 | A * | 5/1900 | Vesey | F42D 1/18 | 237/12.3 A |
| 1,479,070 | A * | 1/1924 | Harris | F42D 1/18 | 102/304 |
| 1,480,894 | A * | 1/1924 | Cockburn | F42D 1/18 | 102/333 |
| 1,507,983 | A * | 9/1924 | Anderson | E21B 33/1204 | 166/192 |
| 1,616,048 | A * | 2/1927 | Holt | F42D 1/18 | 102/304 |
| 2,812,712 | A * | 11/1957 | Ashurst | F42D 1/18 | 102/304 |
| 5,936,187 | A * | 8/1999 | Miller | F42D 1/18 | 102/333 |
| 2008/0047455 | A1* | 2/2008 | Tota | F42D 1/20 | 102/304 |
| 2008/0236434 | A1* | 10/2008 | Gonzalez | F42D 1/18 | 102/313 |
| 2010/0276984 | A1* | 11/2010 | Bassett | F42B 3/087 | 299/13 |
| 2016/0209196 | A1* | 7/2016 | Phillips | F42D 1/18 | |
| 2020/0072588 | A1* | 3/2020 | Phillips | F42D 3/04 | |

* cited by examiner

WEDGING ARRANGEMENT TO PLUG A BLAST HOLE

CROSS-REFERENCE TO RELATED APPLICATIONS

This application is a National Phase application under 35 U.S.C. 371 of International Application No. PCT/IB2021/058843 filed on Sep. 28, 2021, which application is based upon and claims the benefit of priority from South African Patent Application No. 2021/03117 filed on May 10, 2021, the disclosures of each of which are incorporated herein in their entireties by reference.

FIELD OF THE INVENTION

THIS invention relates to a wedging arrangement to plug or block off a mining blast hole accommodating an explosive charge or propellant, in order to contain the blast energy within the blast hole and fracture the rock surrounding a stemming portion of the hole.

BACKGROUND TO THE INVENTION

As best shown in FIG. 1, a blast hole typically comprises a hole drilled into rock to be blasted, the end of which is fitted with an explosive charge or propellant. Of course, if the blast hole is not plugged at all, a large amount of the blast energy would simply exit the drilled hole. As such, it is well known to insert a blast plug into the drilled hole, with stemming material on either side of the blast plug. This arrangement is sometimes referred to a stemming device, and is used to confine and contain the blast energy to and within the rock surrounding the blast hole. This in turn maximises the amount of blast energy to where it is needed, namely the rock surrounding the blast hole resulting in efficient energy usage. In use, the stemming device gets compressed to assist in the plugging of the blast hole.

Wedging arrangements to plug a blast hole are known, with the aim of these arrangements being to provide a wedging action to fracture the rock surrounding a stemming portion of the hole.

US2008/0047455, for example, discloses a rock breaking cartridge which comprises a tubular body that incorporates a stemming device therein. Upon activation, the stemming device expands a portion of the tubular body in a radial sense. A preferred embodiment of the stemming device in US2008/0047455 includes opposing wedge components made from wood or a suitable plastics material. The wedge components have mating sloping faces, so that when activated, the sloping faces ride over each other to radially expand the cartridge. The cartridge is thereby locked in position, with the expanded portion of the tubular body frictionally engaged with the wall of the blast hole.

In another example, WO2015/035456 discloses a plug for stemming a blast hole in a mine, the plug comprising an active wedge-shaped member having a sloping face received in sliding relationship with a matching face of a passive wedge-shaped member. In use, the active wedge-shaped member is positioned nearest to an explosive material in the blast hole and the passive wedge-shaped member is positioned further from the explosive material in the blast hole. Upon detonation of the explosive material, the active wedge-shaped member is forced to slide relative to the passive wedge-shaped member so that both wedge-shaped members exert diametrically opposed forces against a wall of the blast hole and are locked in place.

In both cases, however, the wedge components are separate, loose components, which makes them cumbersome to use. In addition, when activated, the movement is not directed or aligned, which would tend to reduce surface contact (and thus reduce the force applied to the hole wall.)

It is thus an aim of the present invention to provide a wedging arrangement in which the wedging bodies are held together, unable to be pulled apart, but that, when in use, can slide relative to each other, when pushed together (i.e. subjected to external loading stress forces, in particular compressive stress forces), to exert diametrically opposed forces against a wall of the blast hole. The end result is that the wedging arrangement gets locked together in place within the blast hole in order to plug the blast hole and contain the blast energy.

SUMMARY OF THE INVENTION

According to a broad aspect of the invention, there is provided a wedging arrangement to plug and fracture a blast hole accommodating an explosive charge, the blast hole defining a stemming portion, the wedging arrangement comprising a first body and a second body arranged to slide at an angle relative to each other; wherein each of the first and second bodies defining a holding arrangement for holding the first and second parts relative to each other, the wedging arrangement being configurable between a default configuration in which the holding arrangement holds the first and second bodies relative to each other and a stressed configuration in which the wedging arrangement is subjected to external stress forces thereby causing the holding arrangement to be disengaged to allow the first and second bodies to angularly slide relative to each other, in use to lock the wedging arrangement in place within the blast hole in order to plug the blast hole and contain the blast energy resulting from the explosive charge being detonated.

In an embodiment, the first body may comprise a sloping surface and a first stopping member protruding from the sloping surface, and the second body may comprise a complimentary sloping surface comprising walls defining a recess that is arranged to accommodate the stopping member, wherein the walls defining the recess are arranged to abut against the stopping member to prevent the second body from sliding relative to the first body in a first direction but allow the second body to slide relative to the first body in a second opposite direction away from the stopping member.

According to the invention, there is provided a wedging arrangement to plug a blast hole accommodating an explosive charge, the wedging arrangement comprising a first body terminating in a first angled (or sloping) end face and a second body, axially aligned with the first body, the second body terminating in a second angled (or sloping) end face, complementary to (so as to co-axially abut against) the first angled end face of the first body, the first and second angled end faces defining a complementary holding arrangement to hold the first and second bodies together, the holding arrangement being arranged to prevent the first and second bodies from being pulled apart in first opposite directions transverse to the longitudinal axis of the wedging arrangement, but when the first and second bodies, when in an axially aligned, default configuration, are pulled apart in second opposite directions transverse to the longitudinal axis of the wedging arrangement, or are pushed or compressed together in a direction transverse to the longitudinal axis of the wedging arrangement, the holding arrangement allows the first and second bodies to angularly slide apart, relative to and sidewardly away from, each other, thereby exerting diametrically opposed forces against a wall of the blast hole, so as to locate and lock the wedging arrangement in place within the blast hole in order to plug the blast hole and contain the blast energy resulting from the explosive charge being detonated. In particular, this movement of the first and second bodies away from each other is directed and aligned, thus maximising surface contact and the related force applied to the wall of the blast hole.

The wedging arrangement is typically cylindrical, with the cross-sectional shape of the wedging arrangement being selected from any of the following shapes: circle, triangle, rectangle, hexagon, octagonal or polygon. Clearly, any other regular or irregular shape may be used. The wedging arrangement typically has a smaller width or diameter than the width or diameter of the blast hole, to enable the first and second bodies to slide apart, relative to and sidewardly away, from each other. In the case of a round cylindrical wedging arrangement, the radius or arc of the wedging arrangement may be selected to match the radius of the blast hole that is being plugged.

Conveniently, the outside surface of the first and/or second bodies can be smooth or ribbed with a pattern to create friction with the wall of the blast hole.

The first and/or second bodies may be made from concrete and/or ceramic and/or plastic and/or wood and/or a suitable polymer and/or wood-pulp/paper.

In an embodiment, the first and/or second bodies may define an inner cavity to accommodate a liquid, gel, gas, solid or fluid, such as a non-Newtonian fluid, or even an explosive, for example, for charging the stemming portion of the hole and for blasting boulders and the like, or any combination.

In an embodiment, the first or second bodies may be attached to the ends of a cartridge explosive (or any other type of packaged explosive), with a plurality of cartridge explosives being connectable in this way to interlock them together to form a continuous, axially aligned explosives charge. In particular, the first body may be connected to one end of a cartridge explosive, with the end of an adjacent cartridge explosive being fitted with the second body, with the first and second bodies being connected together by the holding arrangement defined above. The first and second bodies would typically accommodate a detonating cord to connect the cartridge explosives together.

The first and second bodies may resemble bottles to form a cavity, with the bottle-top shape formed at the base of the first and second bodies.

In an embodiment, the base ends of the first and/or second bodies are rounded at the edges to facilitate installation of the wedging arrangement within the blast hole.

In an embodiment, the base ends of the first and/or second bodies may have a concave shape at the centre to facilitate positioning of the wedging arrangement.

In an embodiment, the angled (or sloping) end faces of the first and/or second bodies makes an angle of between 15 degrees and 85 degrees, relative to a horizontal (i.e. the base ends, typically).

In the specification below, although the first body is designated as being the lower body with respect to the second body, the orientation of the wedging arrangement is interchangeable i.e. if turned upside down, the second body would be lower than the first body.

In an embodiment, the first body comprises a cylindrical body portion terminating in the first angled end face, which extends transversely to the body portion, the holding arrangement on the first body comprising an elongate first holding member extending or protruding from the first angled end face, the first holding member having a length corresponding to the length (i.e. diameter in the case of a round cylindrical body portion) of the first angled end face and a width narrower than the width (i.e. diameter in the case of a round cylindrical body portion) of the first angled end face.

The elongate first holding member includes an elongate sliding track and a relatively enlarged head proximate the operatively upper end of the elongate sliding track, when in use. The enlarged head defines a stopping member to ensure that, when the first and second bodies are pushed or compressed together when in their axially aligned, default configuration, the second body is only permitted to slidingly move away from the stopping member.

In an embodiment, the elongate sliding track of the elongate first holding member comprises:

- a pair of first track side walls, extending transversely away from the first angled end face, so as to define recesses on either side of the sliding track; and
- an operatively upper track face substantially parallel to the first angled end face.

In an embodiment, the pair of first track side walls comprises a pair of parallel upper first track faces and a pair of inwardly tapering lower first track faces, transversely adjacent to the first angled end face.

The operatively lower end of the first track side walls defines a front end face in line with (i.e. integral with) the cylindrical body portion of the first body.

In an embodiment, the enlarged head of the elongate first holding member comprises a pair of diverging or splayed first head side walls, extending transversely away from the first angled end face, and a rear end face in line with (i.e. integral with) the cylindrical body portion of the first body.

Again, as with the sliding track, the pair of first head side walls comprises a pair of splayed upper first head faces and a pair of inwardly tapering (and splayed) lower first head faces, adjacent the first angled end face.

In an embodiment, the first body is between 36 mm and 2500 mm in length and between 10 mm to 508 mm in width.

In an embodiment, the second body comprises a cylindrical body portion terminating in the second angled end face, which extends transversely to the body portion, the holding arrangement on the second body comprising a pair of spaced apart elongate second holding members extending or protruding from the angled end face.

The second holding members define an elongate sliding track slot therebetween to slidingly accommodate the elongate sliding track of the first holding member, and a relatively enlarged head recess proximate the operatively upper end of the elongate sliding track slot, when in use, to accommodate the relatively enlarged head of the first holding member. As indicated above, when the first and second bodies are in their axially aligned, default configuration, and when the first and second bodies are pushed or compressed together, the enlarged head of the first holding member, in combination with the relatively enlarged head recess, defines a stopping arrangement to ensure that the second body is only permitted to slidingly move away from the stopping member.

In an embodiment, the pair of spaced apart elongate second holding members comprises a pair of spaced apart second track side walls, extending transversely away from the second angled end face, so as to define the elongate sliding track slot, with adjacent operatively lower track faces substantially parallel to the first angled end face.

In an embodiment, the pair of spaced apart second track side walls comprises a pair of parallel upper second track faces, transversely adjacent to the second angled end face, to accommodate the parallel upper first track faces of the first body, and a pair of inwardly tapering lower second track faces, to accommodate the pair of inwardly tapering lower first track faces of the first body. Advantageously, this arrangement ensures that when the wedging arrangement is in its assembled, axially aligned, default configuration, the first and second bodies cannot be pulled apart.

The outer sides of the pair of spaced apart elongate second holding members define side end faces in line with (i.e. integral with) the cylindrical body portion of the second body.

In an embodiment, the pair of spaced apart elongate second holding members further comprises a pair of diverging or splayed second head side walls, extending transversely away from the second angled end face, to define the enlarged head recess relative to the elongate sliding track slot. The diverging or splayed second head side walls are arranged to snugly accommodate the pair of diverging or splayed first head side walls of the enlarged head of the elongate first holding member.

Again, as with the pair of spaced apart second track side walls, the pair of second head side walls comprises a pair of splayed upper second head faces, adjacent the second angled end face. and a pair of inwardly tapering (and splayed) lower second head faces. The pair of splayed upper second head faces and the pair of inwardly tapering (and splayed) lower second head faces are arranged to snugly accommodate the corresponding pair of splayed upper first head faces and the pair of inwardly tapering (and splayed) lower first head faces, respectively, of the first holding member. Advantageously, this arrangement also ensures that when the wedging arrangement is in its assembled, axially aligned, default configuration, the first and second bodies cannot be pulled apart.

In an embodiment, the second body is between 36 mm and 2500 mm in length and between 10 mm to 508 mm in width.

In an embodiment, a fuse slot may be defined within the first and/or second bodies, to receive a fuse of varying strength. In use, once the first and second bodies are assembled, a fuse is inserted into the fuse slot to hold the first and second bodies together (thereby facilitating handling). The fuse is arranged to break when, under sufficient compression, the first and second bodies slide apart, relative to and sidewardly away, from each other.

The fuse slot may be of any size and may be positioned along the surface of the first and/or second bodies at any angle.

In use, the wedging arrangement is assembled by slotting the first and second bodies together. This is done by first placing the first and second bodies side by side, so that the enlarged head recess defined between the second holding members is adjacent the operatively lower end of the elongate sliding track, with the elongate sliding track slot of the second body being aligned with the elongate sliding track of the first body. The first and second bodies are then slid together until the enlarged head of the first holding member of the first body engages fully within the relatively enlarged head recess defined between the second holding members of the second body. In particular, in this fully assembled configuration, the pair of splayed upper first head faces and the pair of inwardly tapering (and splayed) lower first head faces, of the first holding member, snugly abut against the pair of splayed upper second head faces and the pair of inwardly tapering (and splayed) lower second head faces, respectively. This arrangement defines the stopping arrangement, to ensure that the second body is only permitted to slidingly move away from the stopping member.

In another embodiment of the invention, depending upon the rock properties, specifically hardness, and the surface condition of the wall surrounding the blast hole, a three-point curved body design may be implemented, based on the same principles as described above. In this version, when activated (i.e. compressed) the sliding mechanism plugs the blast hole on one side of the blast hole wall and hammers the other side of the blast hole wall with the pointed part of the second body causing cracks in the surface of the blast hole wall. The cracks will then propagate and improve fragmentation of the surrounding rock.

In yet another embodiment of the invention, the wedging arrangement includes additional, intermediate bodies between the first and second bodies. These additional, intermediate bodies include any of the holding arrangements defined above.

Also, the wedging arrangement may be used in holes at any angle including upwardly extending blast holes. The wedging arrangement may be inserted upwardly into the blast hole and secured in place by pressurising a cavity type lower first body with water, fluids, or gas or by using a gas bag.

BRIEF DESCRIPTION OF THE DRAWINGS

These and other features of this invention will become apparent from the following description of one example described with reference to the accompanying drawings in which.

DETAILED DESCRIPTION OF THE DRAWINGS

Figure 1:
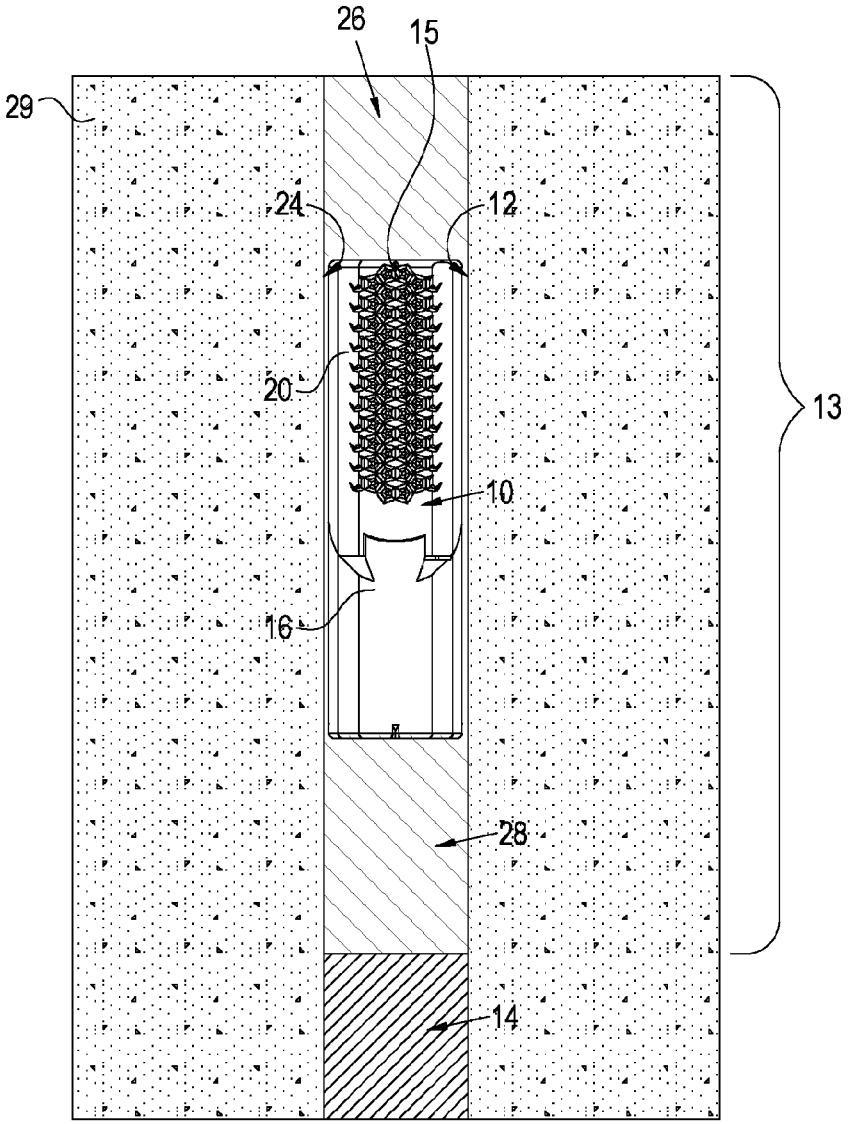
FIG. 1 shows a side view of a typical blast hole accommodating an explosive charge, with a lower stemming material pack and an upper stemming material pack on either side of a wedging arrangement according to a first embodiment of the present invention.

Referring first to FIG. 1, a wedging arrangement 10 to plug a blast hole 12 accommodating an explosive charge 14 is shown, the blast hole 12 defining a stemming portion 13. At a high level, with reference to FIGS. 2 to 4 as well, the wedging arrangement 10 comprises a first body 16 terminating in a first angled (or sloping) end face 18. The wedging arrangement 10 further comprises a second body 20, axially aligned with the first body 16, the second body terminating in a second angled (or sloping) end face 22, complementary to (so as to co-axially abut against) the first angled end face 18 of the first body 16.

Figure 2:
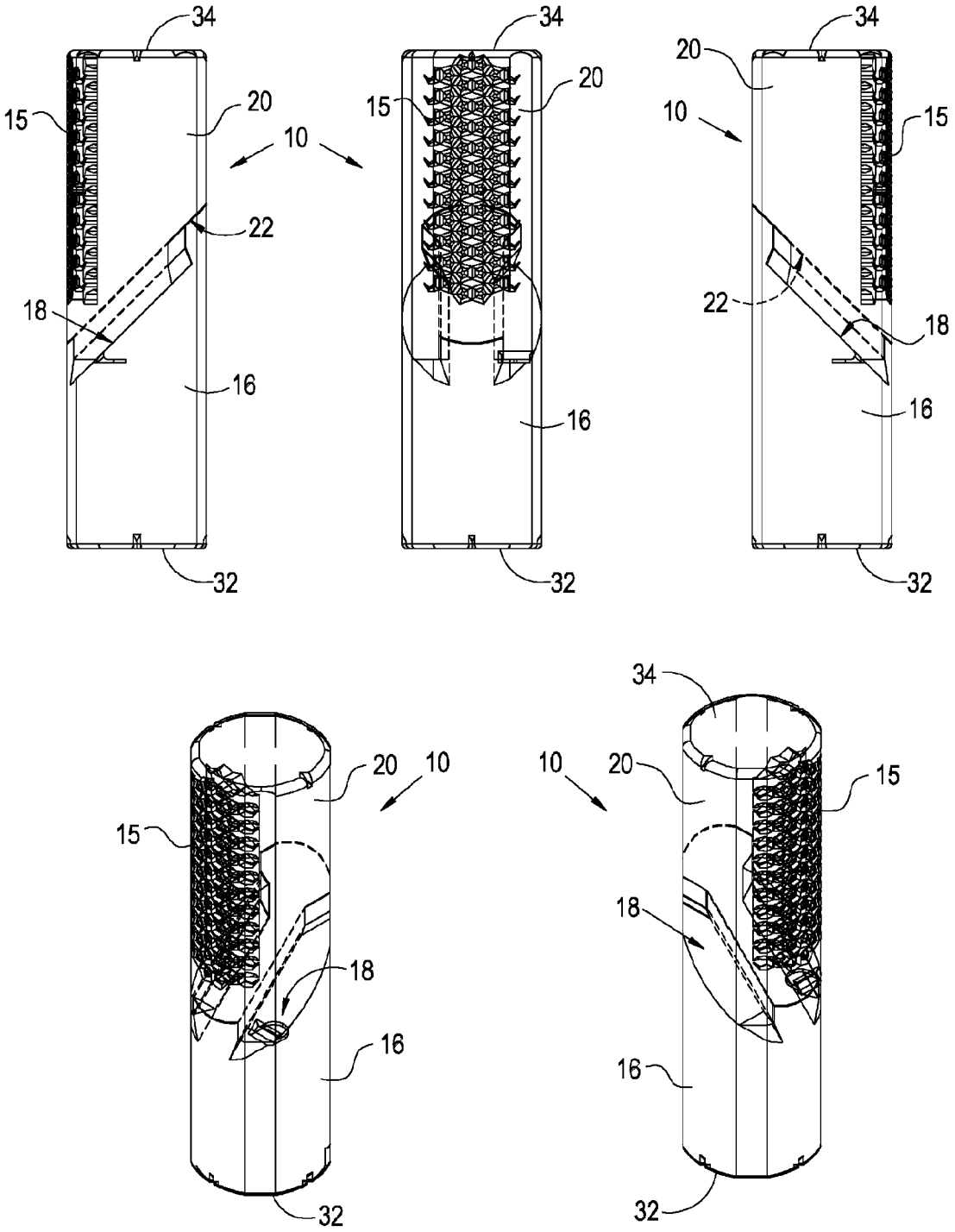
FIG. 2 shows various views of the wedging arrangement of the present invention, comprising first and second bodies, in an assembled, axially aligned, default configuration.

The first and second angled end faces 18, 22 define a complementary holding arrangement to hold the first and second bodies together, as best shown in FIGS. 1 and 2. The holding arrangement is arranged to prevent the first and second bodies 16, 20 from being pulled apart, but when the first and second bodies 16, 20, when in an axially aligned, default configuration, as shown in FIGS. 1 and 2, are pushed or compressed together, the holding arrangement allows the first and second bodies 16, 20 to slide apart, relative to and sidewardly away from, each other, at an angle, thereby exerting diametrically opposed forces against a wall 24 of the blast hole 12. The result of this movement is to lock the wedging arrangement 10 in place within the blast hole 12 in order to plug the blast hole 12 and contain the blast energy resulting from the explosive charge 14 being detonated.

In use, as best shown in FIG. 1, the wedging arrangement 10 is inserted into the blast hole 12 with the explosive charge 14, with top and bottom stemming material 26, 28, respectively, on either ends of the wedging arrangement 10. In certain applications, the top stemming material 26 may be located outside the blast hole 12. In other applications, the bottom stemming material 28 may be omitted with the wedging arrangement 10 being placed directly onto the explosive charge 14, in cases where the viscosity of the explosive charge 14 is sufficient to hold the wedging arrangement 10.

Upon detonation of the explosive charge 14, the blast energy exerts sufficient force on the wedging arrangement 10 to cause the first and second bodies 16, 20 to slide relative to each other, so as to be axially misaligned, thereby exerting diametrically opposed forces against the wall 24 surrounding the blast hole 12. The wedging arrangement 10 thus gets wedged in place within the blast hole 12, in order to confine and contain the blast energy within the blast hole 12, and thus improve fragmentation of the rock 29 surrounding the blast hole 12.

Figure 7:
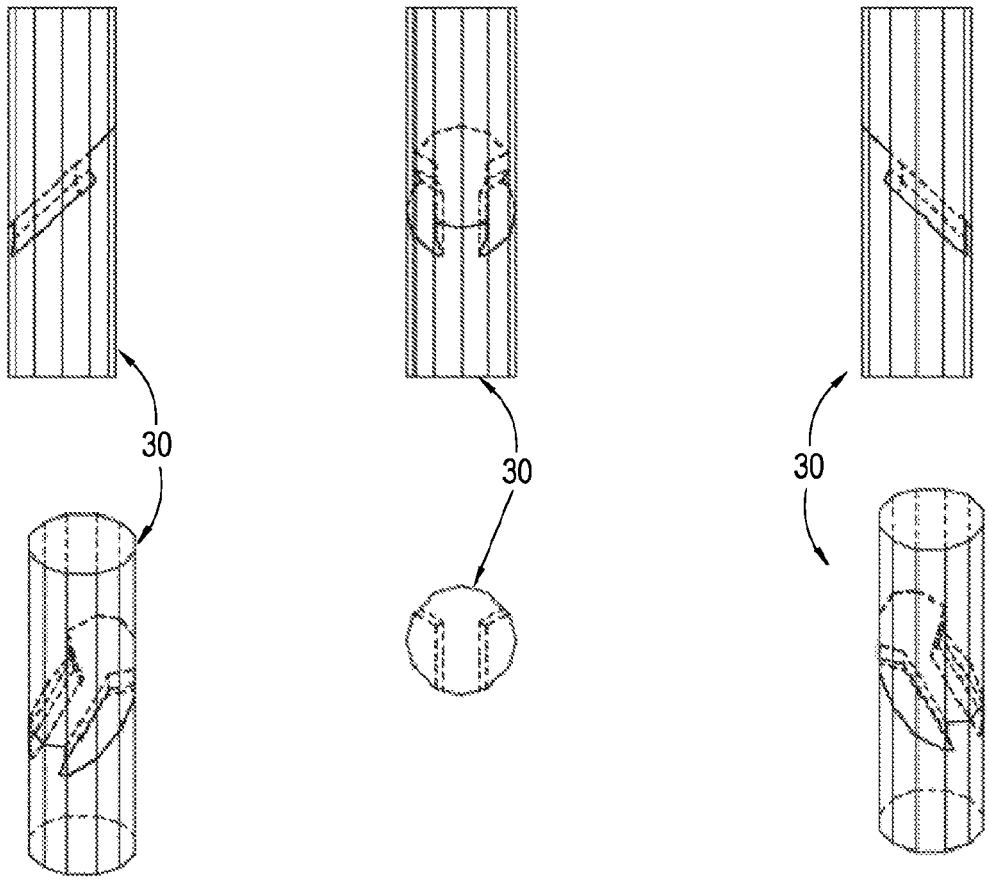
FIG. 7 shows various views of a wedging arrangement according to a fourth embodiment of the present invention.

The wedging arrangement 10 is typically cylindrical, with the cross-sectional shape of the wedging arrangement 10 being selected from any of the following shapes: circle, triangle, rectangle, hexagon, octagonal or polygon. FIG. 7 shows a 12-sided polygon wedging arrangement 30, which is particularly useful for hard rock applications where additional friction is required between the wedging arrangement 30 and the surrounding wall of the blast hole, to prevent blowouts. The polygon angles hammer against the blast hole wall to causes cracks in the surface of the blast hole wall. The cracks will then propagate and improve fragmentation. The details of the wedging arrangement 30 are the same as those described below, with particular reference to FIGS. 1 to 4, and will thus not be described in more detail. Clearly, any other regular or irregular shape may be used.

As best shown in FIG. 1, the wedging arrangement 10 typically has a smaller width or diameter than the width or diameter of the blast hole 12, to enable the first and second bodies 16, 20 to slide apart, relative to and sidewardly away from, each other. In the case of a round cylindrical wedging arrangement 10, the radius or arc of the wedging arrangement 10 may be selected to match the radius of the blast hole 12 that is being plugged.

Figure 4:
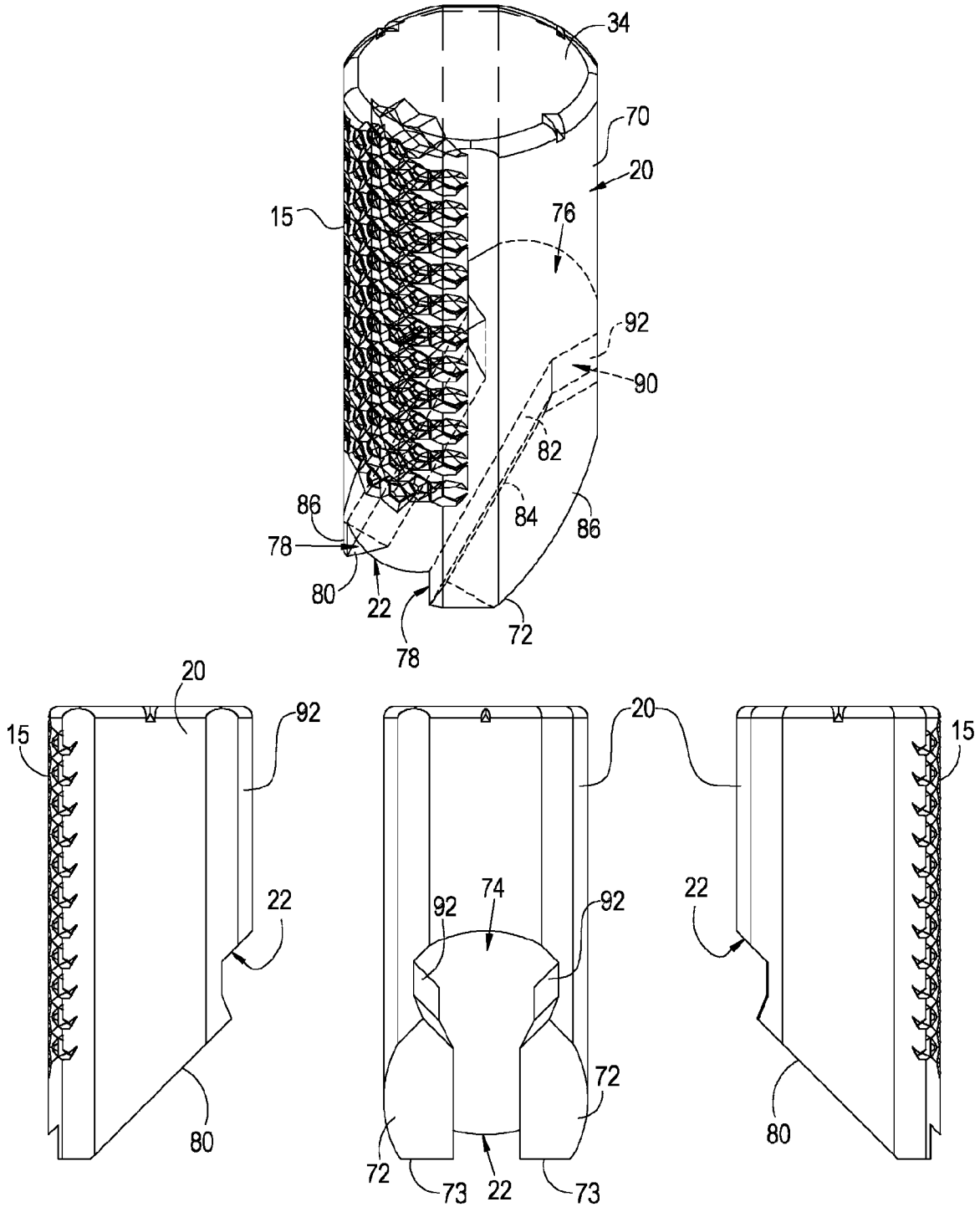
FIG. 4 shows various views of the second body of the wedging arrangement of the present invention.

Conveniently, the outside surface of the first and/or second bodies 16, 20 can be smooth, as shown in FIG. 5 to 8B, or ribbed with a pattern 15, as shown in FIGS. 1 to 2 and 4, to create friction with the wall 24 of the blast hole 12.

The first and/or second bodies 16, 20 may be made from concrete and/or ceramic and/or plastic and/or wood and/or a suitable polymer and/or wood-pulp/paper.

In an embodiment, the first and/or second bodies 16, 20 may define an inner cavity to accommodate a liquid, gel, gas, solid or fluid, such as a non-Newtonian fluid, or even an explosive, for example, for charging the stemming portion 13 of the hole 12 and for blasting boulders and the like, or any combination.

In an embodiment, the base ends 32, 34 of the first and/or second bodies 16, 20 are rounded at the edges to facilitate installation of the wedging arrangement 10 within the blast hole 12. In this regard, in the specification below, although the first body 16 is designated as being the lower body with respect to the second body 20, the orientation of the wedging arrangement 10 is interchangeable i.e. if turned upside down, the second body 20 would be lower than the first body 16, and the invention would still operate properly.

In an embodiment, the base 32, 34 of the first and/or second bodies 16, 20 may have a concave shape at the centre to facilitate positioning of the wedging arrangement 10 within the blast hole 12.

In an embodiment, the angled (or sloping) end faces 18, 22 of the first and/or second bodies 16, 20 makes an angle of between 15 degrees and 85 degrees, relative to a horizontal (i.e. the base ends 32, 34, typically).

Figure 3:
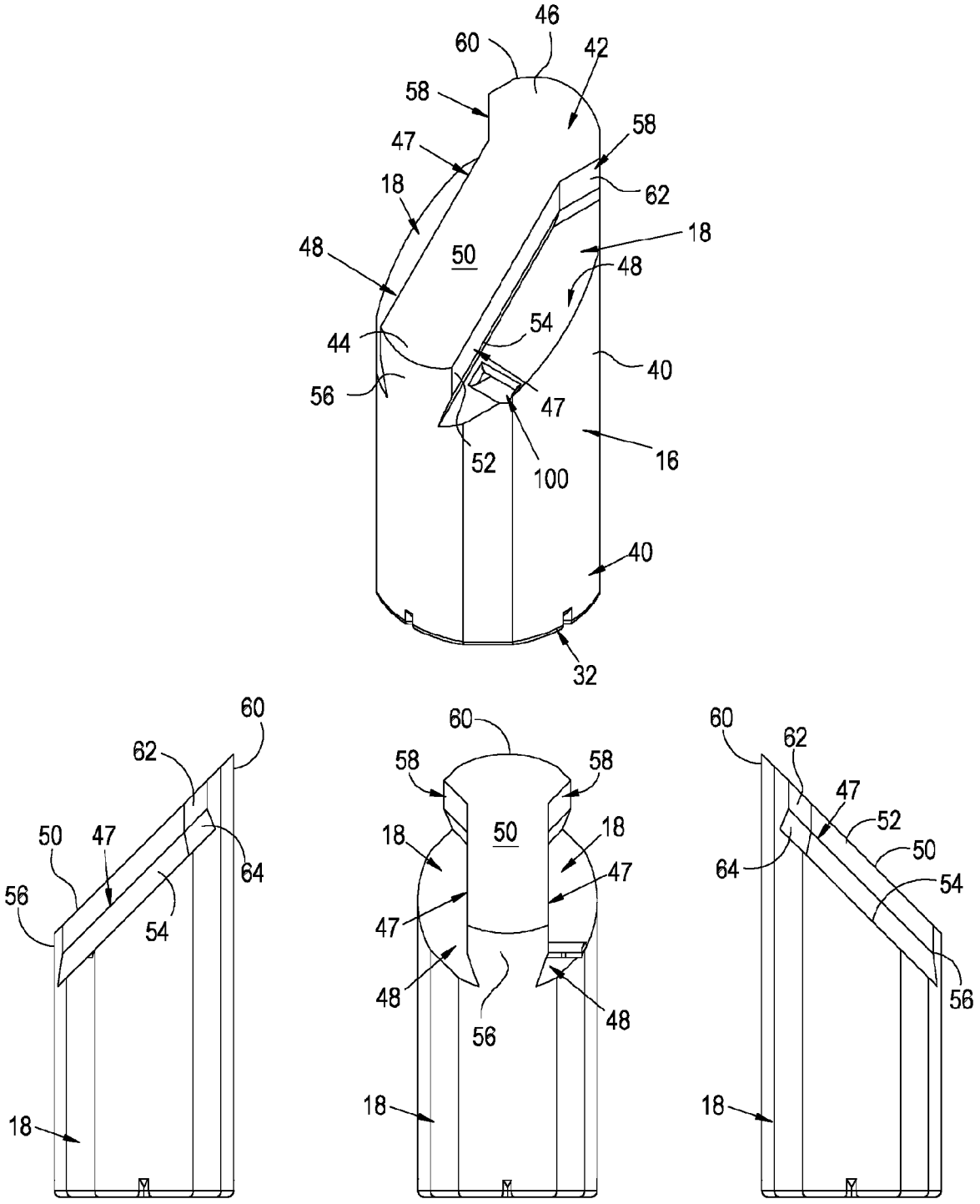
FIG. 3 shows various views of the first body of the wedging arrangement of the present invention.

Turning now in particular to FIG. 3, the first body 16 comprises a cylindrical body portion 40 terminating in the first angled end face 18, which extends transversely to the body portion 40. The holding arrangement on the first body 16 comprises an elongate first holding member 42 extending or protruding from the first angled end face 18, the first holding member 42 having a length corresponding to the length (i.e. diameter in the case of a round cylindrical body portion 40) of the first angled end face 18 and a width narrower than the width (i.e. diameter in the case of a round cylindrical body portion 40) of the first angled end face 18.

The elongate first holding member 42 includes an elongate sliding track 44 and a relatively enlarged head 46 proximate the operatively upper end of the elongate sliding track 44, when in use. The enlarged head 46 defines a stopping member to ensure that, when the first and second bodies 16, 20 are pushed or compressed together when in their axially aligned, default configuration, the second body 20 is only permitted to slidingly move away from the stopping member (i.e. the enlarged head 46).

In an embodiment, the elongate sliding track 44 of the elongate first holding member 42 comprises:

- a pair of first track side walls 47, extending transversely away from the first angled end face 18, so as to define recesses 48 on either side of the sliding track 44; and
- an operatively upper track face 50 substantially parallel to the first angled end face 18.

The pair of first track side walls 47 typically comprises a pair of parallel, substantially vertical, upper first track faces 52 and a pair of inwardly tapering lower first track faces 54, transversely adjacent to the first angled end face 18. As clearly shown, this configuration means that there are two first angled end faces 18.

The operatively lower ends of the first track side walls 47 define a front end face 56 in line with (i.e. integral with) the cylindrical body portion 40 of the first body 16.

In an embodiment, the enlarged head 46 of the elongate first holding member 42 comprises a pair of diverging or splayed first head side walls 58, extending transversely away from the first angled end face 18, and a rear end face 60 in line with (i.e. integral with) the cylindrical body portion 40 of the first body 16.

Again, as with the sliding track 44, the pair of first head side walls 58 comprises a pair of splayed upper first head faces 62 and a pair of inwardly tapering (and splayed) lower first head faces 64, adjacent the first angled end face 18.

In an embodiment, the first body 16 is between 36 mm and 2500 mm in length and between 10 mm to 508 mm in width.

Turning now in particular to FIG. 4, the second body 20 comprises a cylindrical body portion 70 terminating in the second angled end face 22, which extends transversely to the body portion 70. The holding arrangement on the second body 20 comprises a pair of spaced apart elongate second holding members 72 extending or protruding from the second angled end face 22.

The second holding members 72 define an elongate sliding track slot 74 therebetween to slidingly accommodate the elongate sliding track 44 of the first holding member 42, and a relatively enlarged head recess 76 proximate the operatively upper end of the elongate sliding track slot 74, to, in use, accommodate the relatively enlarged head 46 of the first holding member 42.

As indicated above, when the first and second bodies 16, 20 are in their axially aligned, default configuration, as shown in FIGS. 1 and 2, and when the first and second bodies 16, 20 are pushed or compressed together, the enlarged head 46 of the first holding member 42, in combination with the relatively enlarged head recess 76, defines a stopping arrangement to ensure that the second body 20 is only permitted to slidingly move away from the enlarged head 46.

In an embodiment, the pair of spaced apart elongate second holding members 72 comprises a pair of spaced apart second track side walls 78, extending transversely away from the second angled end face 22, so as to define the elongate sliding track slot 74, with adjacent operatively lower track faces 80 being substantially parallel to the second angled end face 22.

In an embodiment, the pair of spaced apart second track side walls 78 comprises a pair of parallel, substantially vertical, upper second track faces 82, transversely adjacent to the second angled end face 22, to accommodate the parallel upper first track faces 52 of the first body 16, and a pair of inwardly tapering lower second track faces 84, to accommodate the pair of inwardly tapering lower first track faces 54 of the first body 16. Advantageously, this gripping arrangement ensures that when the wedging arrangement 10 is in its assembled, axially aligned, default configuration, the first and second bodies 16, 20 cannot be pulled apart.

The outer sides 86 of the pair of spaced apart elongate second holding members 72 define side end faces in line with (i.e. integral with) the cylindrical body portion 70 of the second body 20.

In an embodiment, the pair of spaced apart elongate second holding members 72 further comprises a pair of diverging or splayed second head side walls 90, extending transversely away from the second angled end face 22, to define the enlarged head recess 76 relative to the elongate sliding track slot 74. The diverging or splayed second head side walls 90 are arranged to snugly accommodate the pair of diverging or splayed first head side walls 58 of the enlarged head 46 of the elongate first holding member 42.

Again, as with the pair of spaced apart second track side walls 78, the pair of second head side walls 90 comprises a pair of splayed upper second head faces 92, adjacent the second angled end face 22 and a pair of inwardly tapering (and splayed) lower second head faces 94.

The pair of splayed upper second head faces 92 and the pair of inwardly tapering (and splayed) lower second head faces 94 are arranged to snugly accommodate the corresponding pair of splayed upper first head faces 62 and the pair of inwardly tapering (and splayed) lower first head faces 64, respectively, of the first holding member 42. Advantageously, this arrangement also ensures that when the wedging arrangement 10 is in its assembled, axially aligned, default configuration, the first and second bodies 16, 20 cannot be pulled apart.

In an embodiment, the second body is between 36 mm and 2500 mm in length and between 10 mm to 508 mm in width.

In an embodiment, a fuse 100 slot may be defined within the first and/or second bodies 16, 20, to receive a fuse of varying strength. In use, once the first and second bodies 16, 20 are assembled, a fuse is inserted into the fuse slot 100 to hold the first and second bodies 16, 20 together (thereby facilitating handling). The fuse is arranged to break when, under sufficient compression, the first and second bodies 16, 20 slide apart, relative to and sidewardly away from, each other, as described above.

In use, the wedging arrangement 10 is assembled by slotting the first and second bodies 16, 20 together. This is done by first placing the first and second bodies side 16, 20 by side, so that the enlarged head recess 76 defined between the second holding members 72 is adjacent the operatively lower end of the elongate sliding track 44, with the elongate sliding track slot 74 of the second body 20 being aligned with the elongate sliding track 44 of the first body 16. The first and second bodies 16, 20 are then slid together until the enlarged head 46 of the first holding member 42 of the first body 16 engages fully within the relatively enlarged head recess 76 defined between the second holding members 72 of the second body 20.

In this fully assembled configuration, the pair of splayed upper first head faces 62 and the pair of inwardly tapering (and splayed) lower first head faces 64, of the first holding member 42, snugly abut against the pair of splayed upper second head faces 92 and the pair of inwardly tapering (and splayed) lower second head faces 94, respectively. This arrangement defines the stopping arrangement, to ensure that the second body 20 is only permitted to slidingly move away from the stopping member.

In use, as described above, upon detonation of the explosive charge 14, the blast energy is exerted on the base end 32 of the first body 16 or the second body 20, whichever is closer to the explosive charge 14 (which would also depend upon the orientation of the wedging arrangement 10). As indicated above, this causes the first and second bodies 16, 20 to slide relative to each other, thereby exerting diametrically opposed forces against a wall 24 of the blast hole 12. The wedging arrangement 10 is thus wedged or plugged in place within the blast hole 12.

Before the wedging arrangement 10 is inserted into the blast hole 12, the fuse may be removed from the fuse slot 100. This is not strictly speaking necessary, since the fuse will break when a sufficiently large force is exerted on the assembled wedging arrangement 10.

The wedging assembly 10 would typically be tied to a string and then lowered to the required height within the blast hole 12, in line with safety installation procedures, without the bottom stemming material 28, thus leaving an air gap between the wedging assembly 10 and the explosive charge 14.

Figure 5:
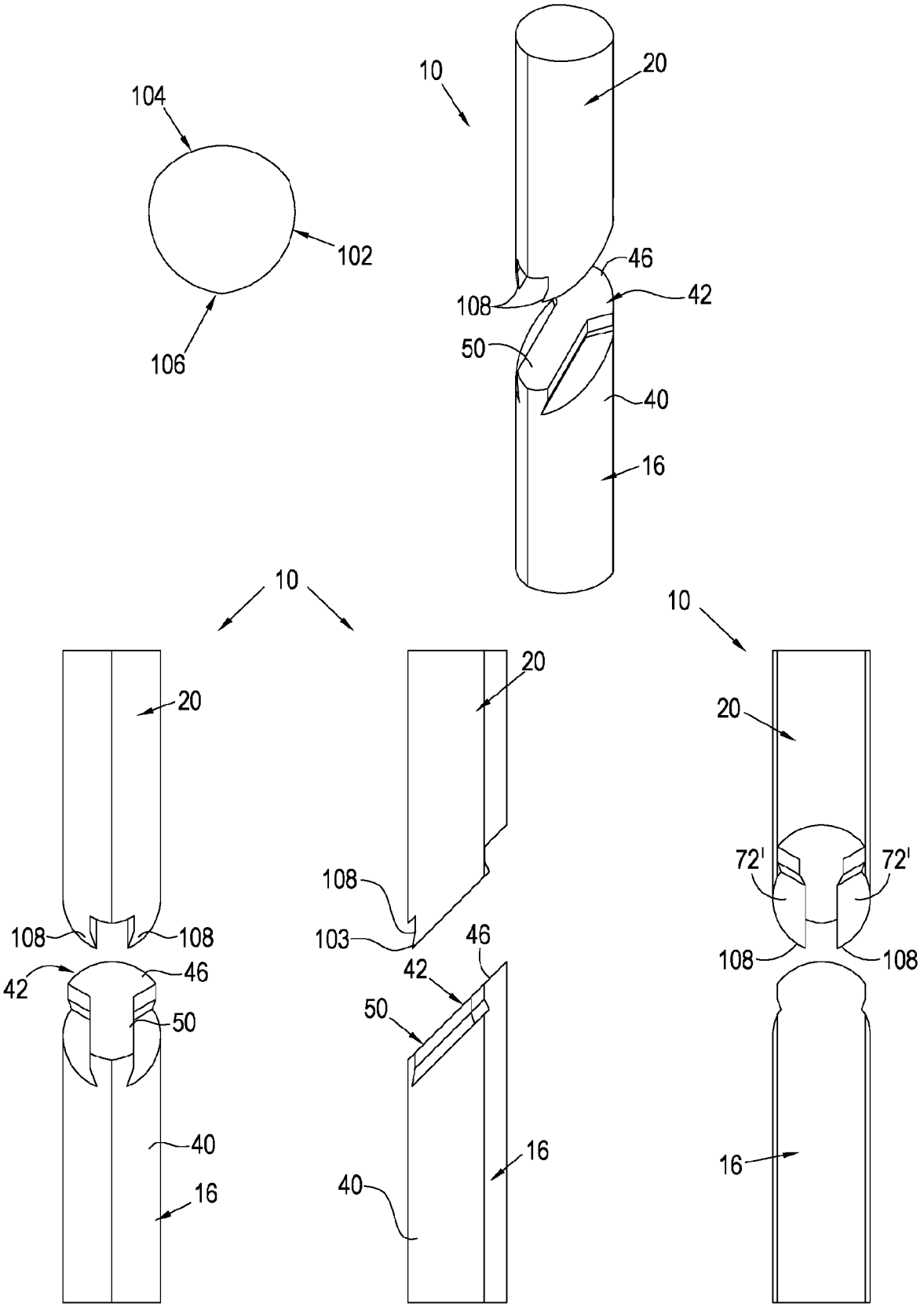
FIG. 5 shows various views of a wedging arrangement according to a second embodiment of the present invention.

In another embodiment of the invention, as shown in FIG. 5, depending on the rock properties, specifically hardness, and the surface condition of the wall 24 surrounding the blast hole 12, a three-point curved body design is used, as best shown by top view 102. The three-point curved body design 102 defines a curved rear surface 104 to contact and plug the blast hole on one side of the blast hole wall, and an opposite, pointy front surface 106 to hammer the other side of the blast hole wall. In particular, in use, the curved rear surface 104 of the first body 16 would primarily contact the blast hole wall, with the pointy front surface 106 of the second body 20 performing the hammer action. However, the overall wedging arrangement 10 works on the same principles as described above, with similar reference numerals being used in FIG. 5, and which will thus not be described again. One difference resides in the second body 20, in that the pair of spaced apart elongate second holding members 72' terminate in pointed tips 108. The second holding members 72 described above with reference to FIG. 4 in particular is slightly different, in that they terminate in truncated flat edges 73, whereas the second holding members 72' terminate in pointed tips 108. However, in one version, the second holding members 72' may not have the pointed tips 108, and so would also be truncated, as per the second holding members 72 described above with reference to FIG. 4.

In this three-point curved body design 102, when activated (i.e. compressed) the sliding arrangement defined between the first and second bodies 16, 20 plugs the blast hole 12 on one side of the blast hole wall 24 and hammers the other side of the blast hole wall 24 with the pointy front surface 106 of the second body 20 causing cracks in the surface of the blast hole wall 24. The cracks will then propagate and improve fragmentation of the surrounding rock, as described above.

Figure 6:
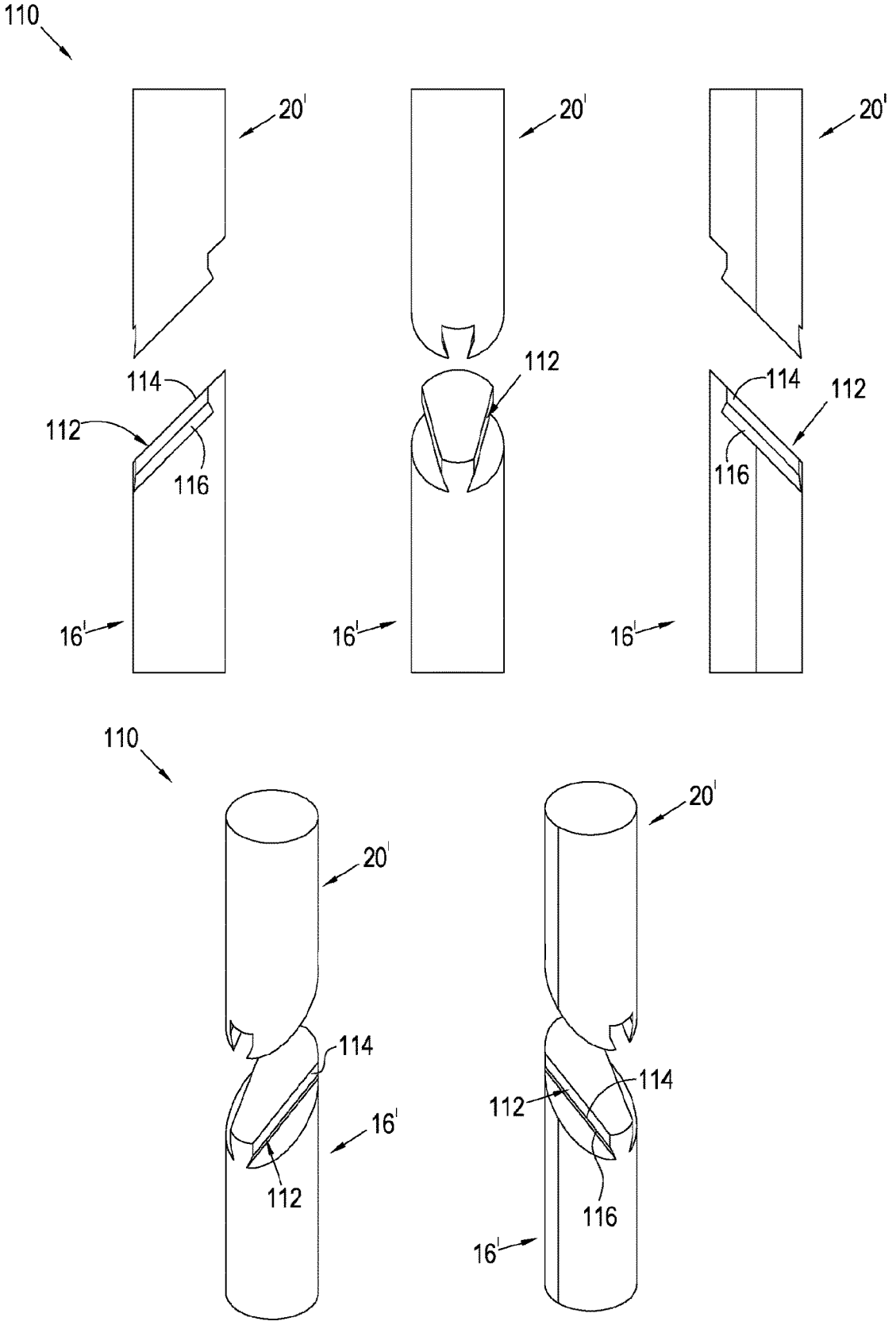
FIG. 6 shows various views of a wedging arrangement according to a third embodiment of the present invention.

In another embodiment of the invention, as shown in FIG. 6, the wedging arrangement 110 is similar to the wedging arrangement shown in FIGS. 1 to 5, but uses slightly modified first and second bodies 16', 20'. As best shown with reference to the modified first body 16', instead of the parallel upper first track faces 52 and related enlarged head 46 shown in FIG. 3, a splayed or tapering track face 112 is provided (with no corresponding enlarged head). Each tapering track face 112 comprises splayed upper first track faces 114 and inwardly tapering splayed lower first track faces 116. The modified second body 20 would be complementarily designed, including a corresponding splayed or tapering elongate sliding track slot (and would similarly also not include the relatively enlarged head recess 76 shown in FIG. 4). As described above with reference to FIG. 5, although the spaced apart elongate second holding members of the second body 20' terminate in pointed tips, as per FIG. 5, in one version, the second holding members may not have the pointed tips, and so would also be truncated, as per the second holding members 72 described above with reference to FIG. 4.

Figure 8A:
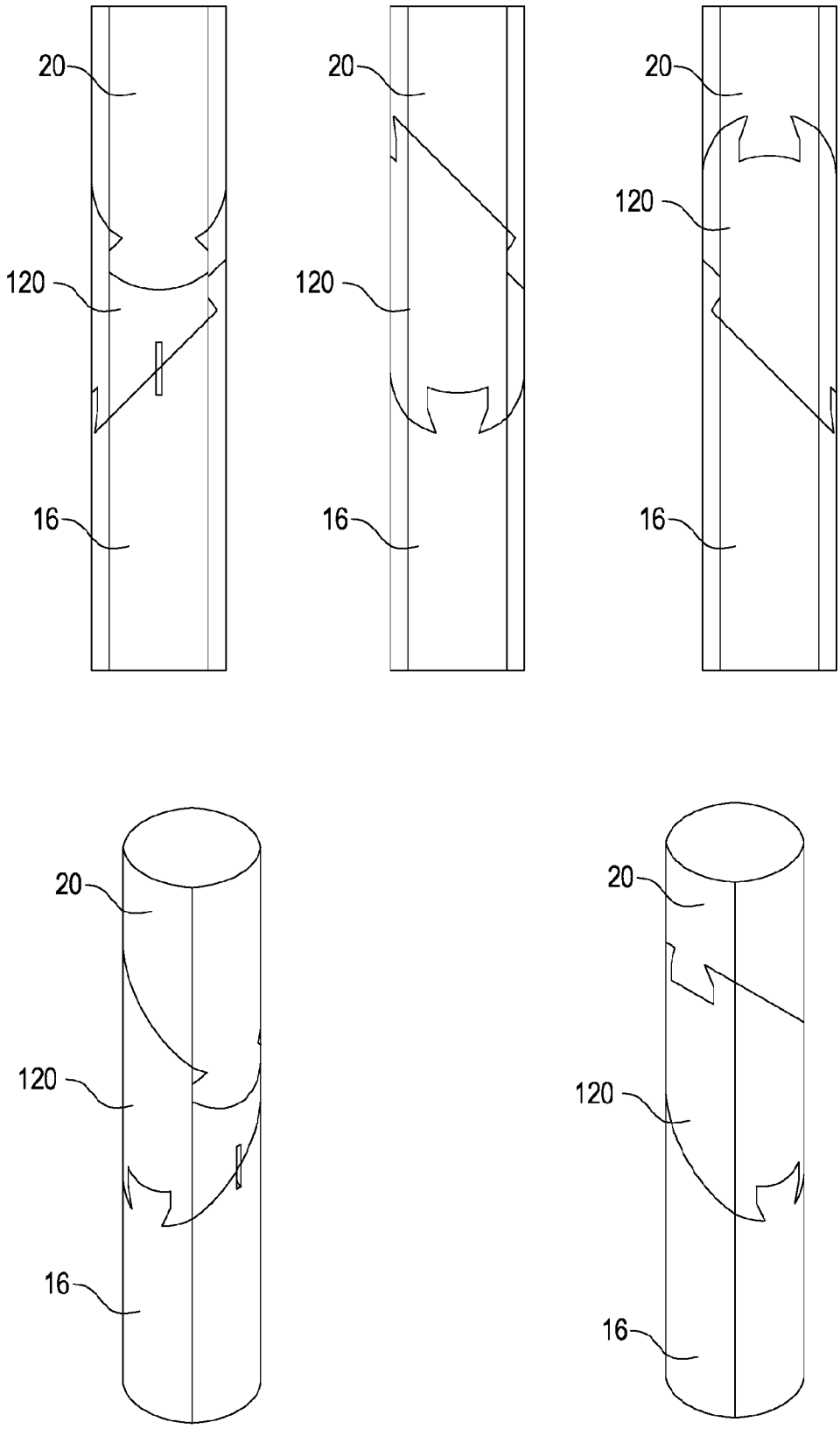
FIGS. 8A and 8B show various views of a wedging arrangement according to a fifth embodiment of the present invention.
Figure 8B:
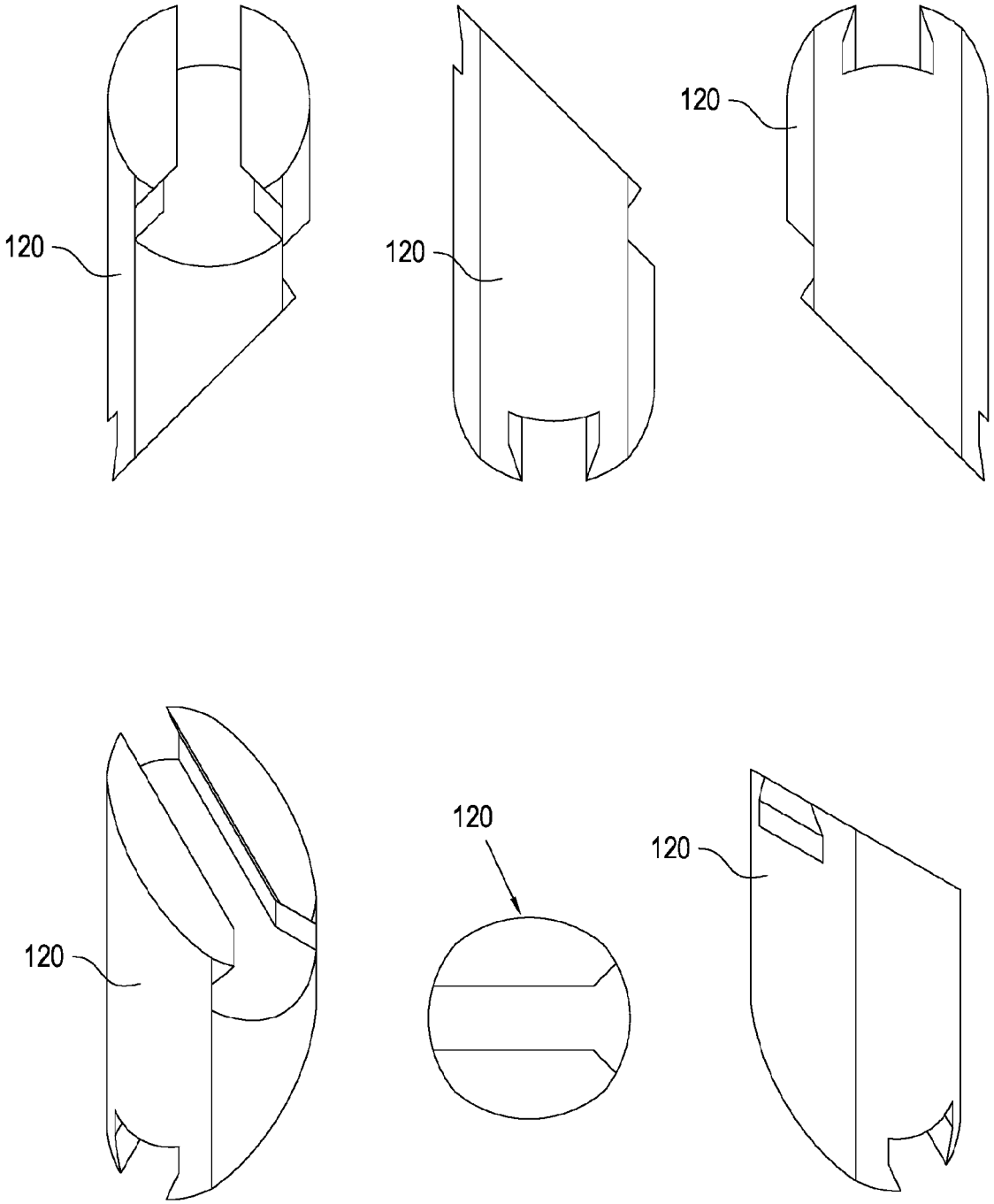

In yet another embodiment of the invention, as shown in FIGS. 8A and 8B, the wedging arrangement 10 includes additional, intermediate bodies 120 between the first and second bodies 16, 20. These additional, intermediate bodies include any of the holding arrangements defined above. As described above with reference to FIGS. 5 and 6, although the spaced apart elongate second holding members of the intermediate bodies 120 terminate in pointed tips, in one version, these bodies may not have the pointed tips, and so may also be truncated, as per the second holding members 72 described above with reference to FIG. 4.

Figure 9A:
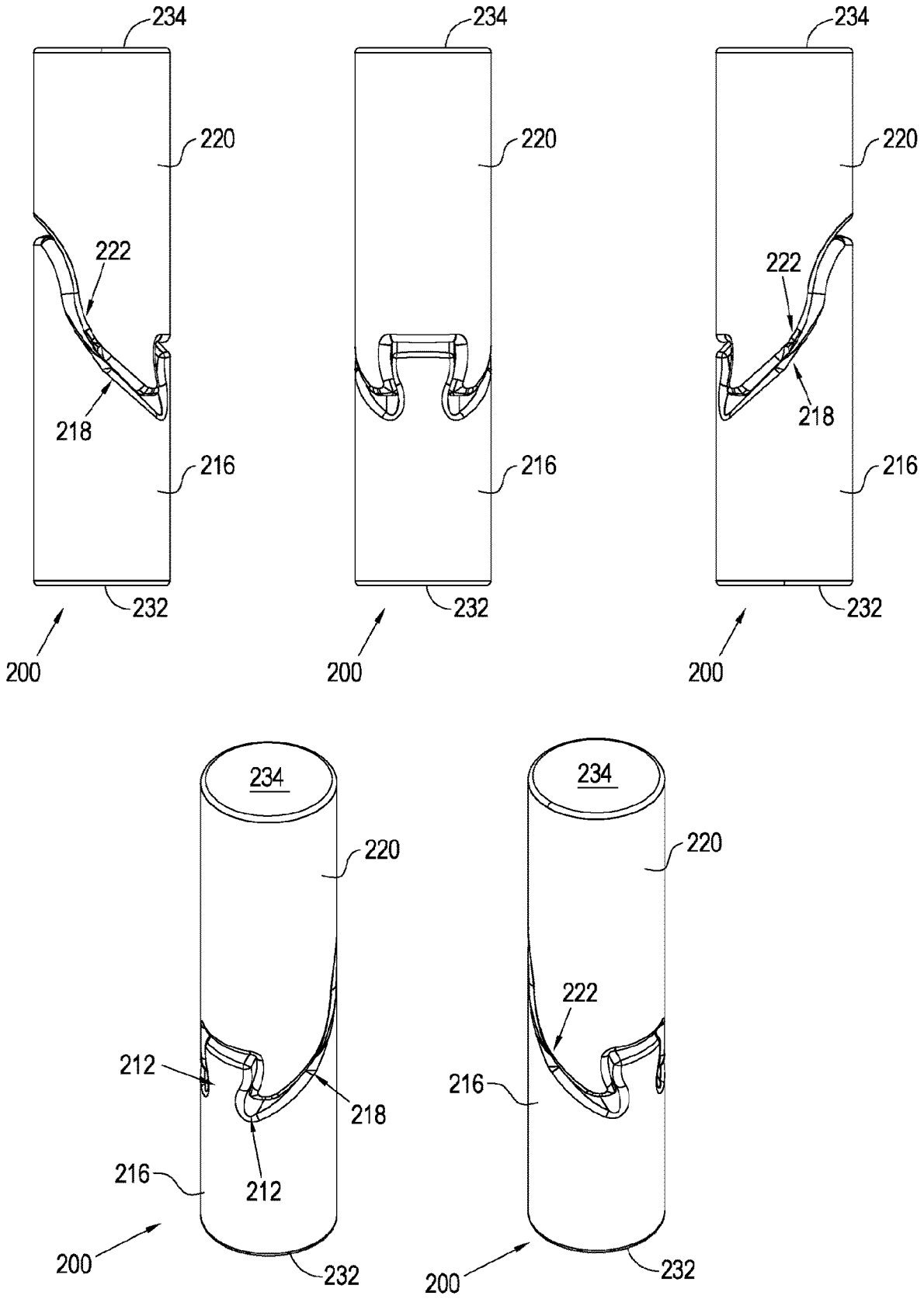
FIGS. 9A to 9C show various views of a wedging arrangement according to a sixth aspect of the present invention.
Figure 9B:
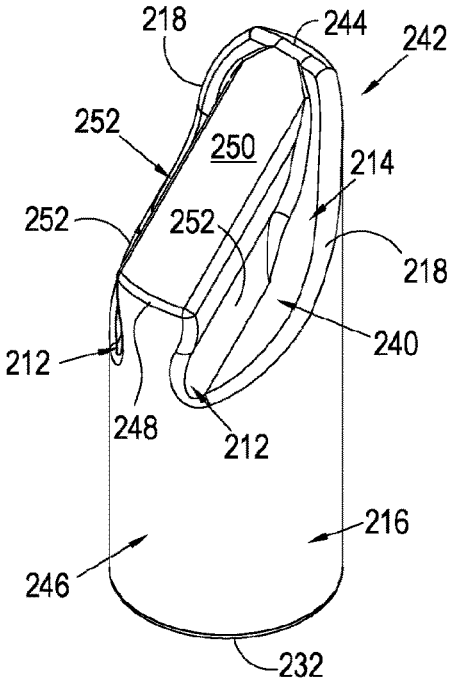
Figure 9B:
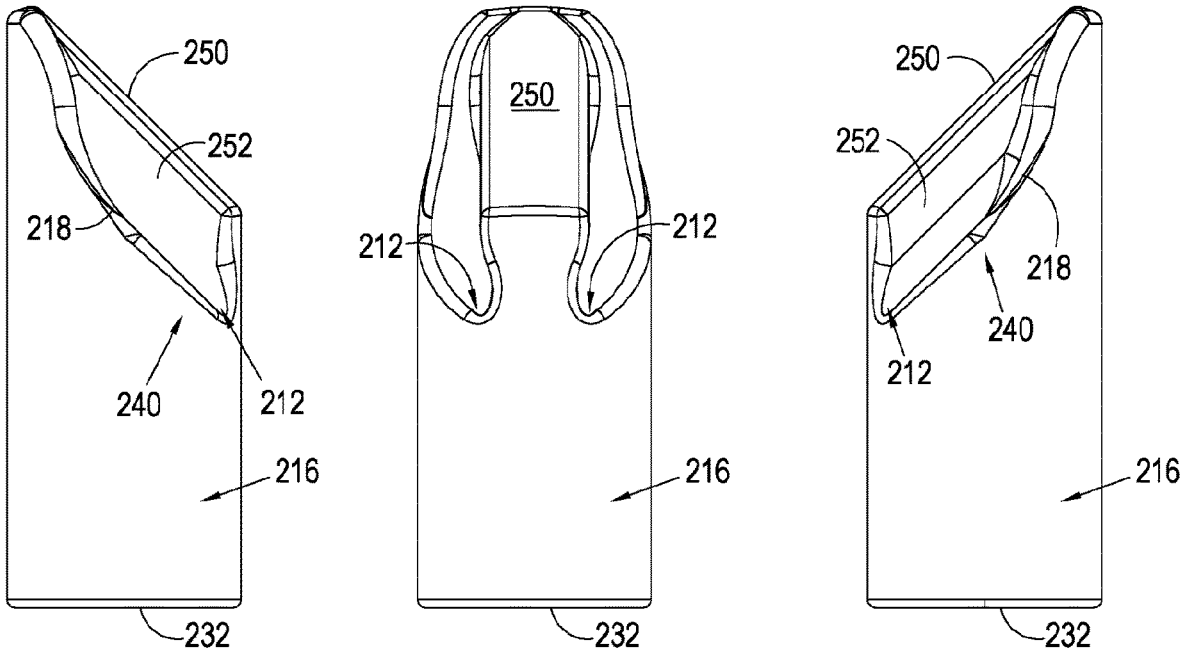
Figure 9C:
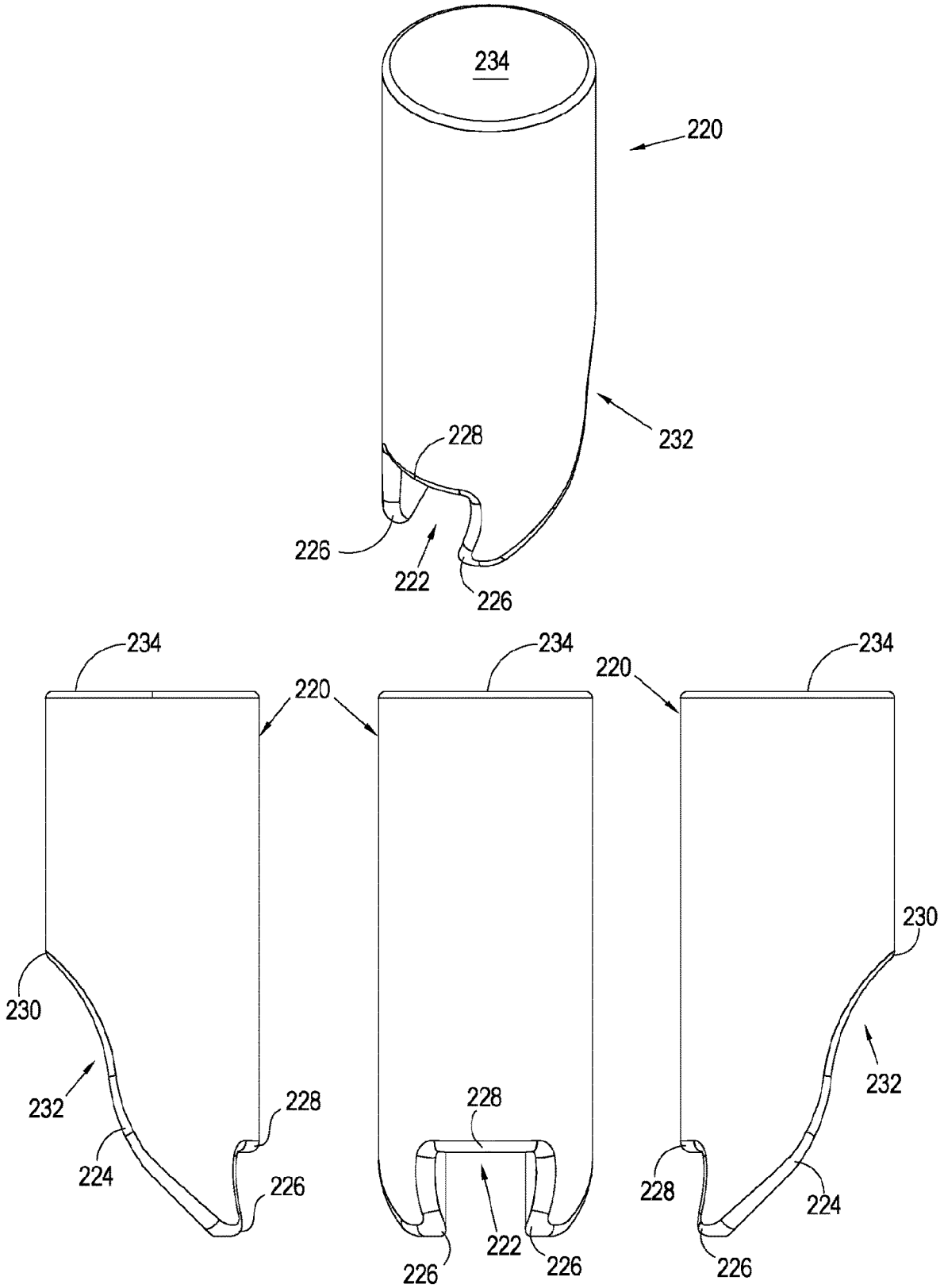

In yet another embodiment of the invention, as shown in FIGS. 9A to 9C, the wedging arrangement designated by reference numeral 200 includes a first body 216 and a second body 220. The first body 216 includes a first angled face 240 that is arranged at an incline relative to an upper end of the first body 216. An inclined/sloping sliding track 250 which is straddled by curved recesses 214 defined by the inclined, lateral walls 252 of the sliding track 250 and curved wall 218 of the first body 216. Each recess 214 on either side of the sliding track 250 defines a stopping formation 212 of a holding arrangement of the wedging arrangement 200, typically a deep end of each of the recesses 214, for accommodating complimentary stopping members 226 of the holding arrangement defined by the second body 220. The sliding track 250 has a first lower end 248 which is integrally formed with an operatively front end 246 of the first body 216, and has a first upper end 244 which is integrally formed with an operatively rear end 242 of the first body 216.

The second body 220 includes a second angled face 232 having a complimentary, sloping recess 222 that is arranged to accommodate the sliding track 250. The second body 220 includes curved side walls 224 which define the sloping recess 222, and which are arranged to be slidably received in the curved recesses 214 of the first body 216.

An operatively lower end of each of the curved side walls define a stopping member 226 which is arranged to be anchored in the corresponding stopping formation 212 the recesses 214 defined by the first body 216. The second body 220 accordingly includes a second lower end 228 which is arranged to rest on the sliding track 250 of the first body 216 along the first lower end 248 thereof, and also includes a second upper end 230 which is arranged to rest on the first upper end 244 of the first body 216. In use, the second body 220 is slidably located into the curved recesses 214 of the first body 216 via the curved side walls 224 thereof until the stopping members 226 thereof are received in the stopping formations 212 of the first body 216. Once the second body 220 is located in the first body 212, i.e. once the stopping members 226 thereof are received in the stopping formations 212 of the first body 216 and the sliding track 250 is accommodated in the complimentary recess 222 defined by the curved side walls 226 of the second body 220, the second body 220 will only be allowed to be slidably displaced relative to the first body 216 when the stopping members 226 are moved away from the stopping formations 212 in the direction of the first upper end 244 of the first body 216. The wedging arrangement 200 described herein, could be used effectively in blast holes surrounded by hard rock, as described above, by causing cracks in the surface of the blast hole wall, with these cracks then propagating to improve fragmentation of the blasted rock.

The invention claimed is:

1. A wedging arrangement to plug and fracture a blast hole accommodating an explosive charge, the blast hole defining a stemming portion, the wedging arrangement comprising a first body and a second body arranged to slide at an angle relative to each other; wherein the first and second bodies define a holding arrangement for holding the first and second parts relative to each other, the wedge arrangement being configurable between a default configuration in which the holding arrangement holds the first and second parts relative to each other, and a stressed configuration in which the first and second bodies are subjected to stress forces which thereby cause the holding arrangement to be disengaged to allow the first and second bodies to angularly slide relative to each other, in use slide sidewardly towards the walls of the blast hole so as to locate and lock the wedging arrangement in place within the blast hole in order to plug the blast hole and contain the blast energy resulting from the explosive charge being detonated, wherein the first body terminates in a first angled end face and the second body, axially aligned with the first body when the wedge arrangement is in the default configuration, terminates in a second angled end face, complementary to the first angled end face of the first body, further wherein the first body comprises a cylindrical body portion terminating in the first angled end face, which extends transversely to the body portion, the holding arrangement on the first body comprising an elongate first holding member extending or protruding from the first angled end face, the first holding member having a length corresponding to the length of the first angled end face and a width narrower than the width of the first angled end face, wherein the elongate first holding member includes an elongate sliding track and a relatively enlarged head proximate the operatively upper end of the elongate sliding track, when in use, further wherein the enlarged head defines a stopping member to ensure that, when the first and second bodies are pushed or compressed together when in their axially aligned, default configuration, the second body is only permitted to slidingly move away from the stopping member.

2. The wedging arrangement according to claim 1, is cylindrical, with the cross-sectional shape of the wedging arrangement being selected from any of the following shapes: circle, triangle, rectangle, hexagon, octagonal or polygon.

3. The wedging arrangement according to claim 1, wherein the diameter or width of the wedging arrangement is smaller than the diameter or width of the blast hole, to enable the first and second bodies to angularly slide apart, relative to and sidewardly away from, each other, further wherein the outside surface of the first and/or second bodies is smooth or ribbed with a pattern to create friction with the wall of the blast hole.

4. The wedging arrangement according to claim 1, wherein the first and/or second bodies define an inner cavity to accommodate a liquid, gel, gas, solid or fluid, including a non-Newtonian fluid, or an explosive, for charging the stemming portion of the hole and for blasting boulders and the like, or any combination.

5. The wedging arrangement according to claim 1, wherein the base ends of the first and/or second bodies are rounded at the edges to facilitate installation of the wedging arrangement within the blast hole, further wherein the angled end faces of the first and/or second bodies makes an angle of between 15 degrees and 85 degrees, relative to a horizontal.

6. The wedging arrangement according to claim 1, wherein the elongate sliding track of the elongate first holding member comprises:

a pair of first track side walls, extending transversely away from the first angled end face, so as to define recesses on either side of the sliding track; and an operatively upper track face substantially parallel to the first angled end face, wherein the pair of first track side walls comprises a pair of parallel upper first track faces and a pair of inwardly tapering lower first track faces, transversely adjacent to the first angled end face, further wherein the operatively lower end of the first track side walls defines a front end face in line with the cylindrical body portion of the first body.

7. The wedging arrangement according to claim 1, wherein the enlarged head of the elongate first holding member comprises a pair of diverging first head side walls, extending transversely away from the first angled end face, and a rear end face in line with the cylindrical body portion of the first body, further wherein the pair of first head side walls comprises a pair of splayed upper first head faces and a pair of inwardly tapering lower first head faces, adjacent the first angled end face, wherein the second body comprises a cylindrical body portion terminating in the second angled end face, which extends transversely to the body portion, the holding arrangement on the second body comprising a pair of spaced apart elongate second holding members extending from the angled end face.

8. The wedging arrangement according to claim 7, wherein the second holding members define an elongate sliding track slot therebetween to slidingly accommodate the elongate sliding track of the first holding member, and a relatively enlarged head recess proximate the operatively upper end of the elongate sliding track slot, when in use, to accommodate the relatively enlarged head of the first holding member, so that when the first and second bodies are in their axially aligned, default configuration, and when the first and second bodies are pushed or compressed together, the enlarged head of the first holding member, in combination with the relatively enlarged head recess, defines a stopping arrangement to ensure that the second body is only permitted to slidingly move away from the stopping member.

9. The wedging arrangement according to claim 8, wherein the pair of spaced apart elongate second holding members comprises a pair of spaced apart second track side walls, extending transversely away from the second angled end face, so as to define the elongate sliding track slot, with adjacent operatively lower track faces substantially parallel to the first angled end face, further wherein the pair of spaced apart second track side walls comprises a pair of parallel upper second track faces, transversely adjacent to the second angled end face, to accommodate the parallel upper first track faces of the first body, and a pair of inwardly tapering lower second track faces, to accommodate the pair of inwardly tapering lower first track faces of the first body.

10. The wedging arrangement according to claim 9, wherein the outer sides of the pair of spaced apart elongate second holding members define side end faces in line with the cylindrical body portion of the second body, wherein the pair of spaced apart elongate second holding members further comprises a pair of diverging or splayed second head side walls, extending transversely away from the second angled end face, to define the enlarged head recess relative to the elongate sliding track slot, wherein the diverging or splayed second head side walls are arranged to snugly accommodate the pair of diverging or splayed first head side walls of the enlarged head of the elongate first holding member.

11. The wedging arrangement according to claim 10, wherein the pair of second head side walls comprises a pair of splayed upper second head faces, adjacent the second angled end face, and a pair of inwardly tapering lower second head faces, the pair of splayed upper second head faces and the pair of inwardly tapering and splayed lower second head faces are arranged to snugly accommodate the corresponding pair of splayed upper first head faces and the pair of inwardly tapering and splayed lower first head faces, respectively, of the first holding member.

12. The wedging arrangement according to claim 1, wherein a fuse slot is defined within the first and/or second bodies, to receive a fuse of varying strength, wherein in use, once the first and second bodies are assembled, a fuse is inserted into the fuse slot to hold the first and second bodies together, and wherein the fuse is arranged to break when, under sufficient stress, the first and second bodies slide apart, relative to and sidewardly away from, each other.

13. The wedging arrangement according to claim 1, wherein the sloped end face of the first and second bodies define a three point curved surface, such that, when the wedging arrangement is under stress, the sliding mechanism facilitates the plugging of the blast hole on one side of the blast hole wall and hammers the other side of the blast hole wall with a pointed part of the second body causing cracks in the surface of the blast hole wall.

14. The wedging arrangement according to claim 1, wherein the elongate first holding member includes an elongate sliding track that is straddled by curved walls, wherein the sliding track and curved walls define curved recesses, wherein the second body comprises a cylindrical body portion terminating in the second angled end face, which extends transversely to the body portion, the holding arrangement on the second body comprising a pair of spaced apart, curved side walls defining a recess for accommodating the elongate sliding track of the first holding member.

15. The wedging arrangement according to claim 14, wherein each of the curved recesses of the first body define stopping formations and one end of the curved side walls define a stopping member arranged to be received and arrested by the corresponding stopping formation.

16. The wedging arrangement according to claim 1, which includes additional, intermediate bodies between the first and second bodies, wherein the intermediate bodies include the holding arrangement.

17. The wedging arrangement according to claim 1, wherein the first body is between 36 mm and 2500 mm in length and between 10 mm to 508 mm in width, and the second body is between 36 mm and 2500 mm in length and between 10 mm to 508 mm in width.

18. A wedging arrangement to plug and fracture a blast hole accommodating an explosive charge, the blast hole defining a stemming portion, the wedging arrangement comprising a first body and a second body arranged to slide at an angle relative to each other; wherein the first and second bodies define a holding arrangement for holding the first and second parts relative to each other, the wedge arrangement being configurable between a default configuration in which the holding arrangement holds the first and second parts relative to each other, and a stressed configuration in which the first and second bodies are subjected to stress forces which thereby cause the holding arrangement to be disengaged to allow the first and second bodies to angularly slide relative to each other, in use slide sidewardly towards the walls of the blast hole so as to locate and lock the wedging arrangement in place within the blast hole in order to plug the blast hole and contain the blast energy resulting from the explosive charge being detonated, wherein the first body terminates in a first angled end face and the second body, axially aligned with the first body when the wedge arrangement is in the default configuration, terminating in a second angled end face, complementary to the first angled end face of the first body, further wherein the sloped end face of the first and second bodies define a three point curved surface, such that, when the wedging arrangement is under stress, the sliding mechanism facilitates the plugging of the blast hole on one side of the blast hole wall and hammers the other side of the blast hole wall with a pointed part of the second body causing cracks in the surface of the blast hole wall.

* * * * *